US007784971B2

(12) United States Patent
Dorogi

(10) Patent No.: US 7,784,971 B2
(45) Date of Patent: Aug. 31, 2010

(54) SYSTEMS AND METHODS FOR THERMAL MANAGEMENT OF LAMPS AND LUMINAIRES USING LED SOURCES

(75) Inventor: Michael Jay Dorogi, Newark, OH (US)

(73) Assignee: ABL IP Holding, LLC, Conyers, GA (US)

( * ) Notice: Subject to any disclaimer, the term of this patent is extended or adjusted under 35 U.S.C. 154(b) by 69 days.

(21) Appl. No.: 11/947,463

(22) Filed: Nov. 29, 2007

(65) Prior Publication Data

US 2008/0130299 A1 Jun. 5, 2008

Related U.S. Application Data

(60) Provisional application No. 60/872,091, filed on Dec. 1, 2006.

(51) Int. Cl.
*F21V 29/00* (2006.01)

(52) U.S. Cl. ..... 362/294; 362/249.02; 362/310; 362/373; 362/800

(58) Field of Classification Search ..... 362/244, 362/249.02, 294, 310, 373, 800
See application file for complete search history.

(56) References Cited

U.S. PATENT DOCUMENTS

| | | | |
|---|---|---|---|
| 4,081,023 | A | 3/1978 | Edelstein et al. |
| 4,411,516 | A | 10/1983 | Adachi et al. |
| 4,729,076 | A | 3/1988 | Masami et al. |
| 4,733,335 | A | 3/1988 | Serizawa et al. |
| 6,517,221 | B1 | 2/2003 | Xie |
| 6,586,890 | B2 | 7/2003 | Min et al. |
| 6,910,794 | B2 | 6/2005 | Rice |
| 6,911,915 | B2 | 6/2005 | Wu et al. |
| 6,976,769 | B2 | 12/2005 | McCullough et al. |
| 7,048,412 | B2 | 5/2006 | Martin et al. |
| 2003/0086454 | A1 | 5/2003 | Nagano et al. |
| 2004/0169451 | A1 | 9/2004 | Oishi et al. |
| 2004/0213016 | A1 | 10/2004 | Rice |
| 2004/0252502 | A1 | 12/2004 | McCullough et al. |
| 2005/0168994 | A1 | 8/2005 | Jacobson et al. |
| 2005/0258438 | A1 | 11/2005 | Arik et al. |

(Continued)

FOREIGN PATENT DOCUMENTS

| | | | |
|---|---|---|---|
| WO | WO-2008070519 | A2 | 6/2008 |

OTHER PUBLICATIONS

International Search Report and Written Opinion of the International Searching Authority in PCT Application No. PCT/US2007/085875 (now published application No. WO-2008-070519A2) issued May 13, 2008 by the U.S. Patent and Trademark Office, acting as the International Searching Authority.

*Primary Examiner*—Sandra L O'Shea
*Assistant Examiner*—Meghan K Dunwiddie
(74) *Attorney, Agent, or Firm*—Kilpatrick Stockton LLP

(57) ABSTRACT

LED module assemblies and luminaires that reduce thermal issues associated with LED lamp energy dissipation are disclosed. In one embodiment, an optimized conduction path from the LED to the exterior of the luminaire is created through the use of heat pipes integrated into the LED module assembly and luminaire. In this embodiment, a significant reduction in thermal transfer to the interior of the enclosure may be implemented, while allowing maximum energy dissipation from the LEDs.

25 Claims, 10 Drawing Sheets

U.S. PATENT DOCUMENTS

2006/0001384 A1 1/2006 Tain et al.
2006/0092666 A1 5/2006 Jeong et al.
2007/0001582 A1 1/2007 Shin et al.
2007/0019419 A1 1/2007 Hafuka et al.
2007/0120137 A1 5/2007 Wilson et al.

SYSTEMS AND METHODS FOR THERMAL MANAGEMENT OF LAMPS AND LUMINAIRES USING LED SOURCES

This application claims priority to U.S. Provisional Application No. 60/872,091, filed Dec. 1, 2006, entitled "System and Method for Thermal Management of Lamps and Luminaires Using LED Sources," the entire contents of which are hereby incorporated by reference.

FIELD OF THE INVENTION

This invention relates to thermal management for light emitting diode based lighting systems.

BACKGROUND OF THE INVENTION

The purpose of a lamp is to convert electrical energy to visible light. There are a variety of lamps used in the lighting industry. Some examples are high intensity discharge ("HID"), fluorescent, incandescent, and light emitting diode ("LED"). Each of these lamps emits and dissipates energy in the form of radiant energy and heat in various amounts. For example, a 400 watt metal halide lamp converts approximately 112 watts to visible energy, 20 watts to UV energy, 72 watts to IR energy, while the remaining 200 watts of energy is converted to heat and dissipated to the surrounding environment via conduction through the lamp base and convection off the glass envelope. An LED used for lighting or illumination converts electrical energy to light in a fundamentally different way than HID, fluorescent, and incandescent lamps, resulting in very little radiant energy outside the visible spectrum. The bulk of the energy lost in the conversion process is dissipated as thermal energy through the LED chip and the mechanical structure that surrounds it. The energy conversions (percent of electrical energy input) for the aforementioned light sources are shown in the Table 1.

TABLE 1

| | Energy conversion of various light sources (percent of electrical energy input) | | | |
|---|---|---|---|---|
| | HID | Fluorescent | Incandescent | LED |
| Visible | 28 | 23 | 5 | 12 |
| UV | 5 | 0 | 0 | 0 |
| IR | 18 | 36 | 90 | 0 |
| Total Radiant | 51 | 59 | 95 | 12 |
| Conduction & Convection | 49 | 41 | 5 | 88 |

As shown by Table 1, a significant amount of energy is converted to heat by the lamp. In any luminaire design, the heat generated by the lamp may cause problems related to the basic function of the lamp and luminaire. Benefits associated with effective removal of thermal energy from within the luminaire include improved luminaire life, smaller (lower cost) package sizes, and improved lumen output in some lamp types, such as fluorescent and LED. An additional benefit of removing heat from the luminaire is that the luminaire may then be operated in a higher ambient temperature environment without compromising luminaire life or performance. In the case of an LED, better thermal management allows the LED to be driven at higher power levels while mitigating the negative effects on life and light output normally associated with higher power input levels.

There are three mechanisms for dissipating thermal energy from an LED: conduction, convection, and radiation. Conduction occurs when LED chips, the mechanical structure of the LEDs, the LED mounting structure (such as printed circuit boards), and the luminaire housing are placed in physical contact with one another. Physical contact with the LEDs is generally optimized to provide electrical power and mechanical support. Traditional means of providing electrical and mechanical contact between LEDs and the luminaire provide poor means of conduction between the LEDs and external luminaire surfaces (such as die cast housing). In addition, the location of LEDs is often determined by the desired optical performance of the luminaire. This often necessitates mounting LEDs a large distance from effective heat dissipating structures of the luminaire, which further impedes the conductive transfer of heat out of the luminaire envelope by creating a longer thermal path, introducing additional thermal interfaces, introducing materials with a lower thermal conductivity, or a combination thereof. A further disadvantage of using a thermally conductive structure within the luminaire envelope is that it allows dissipation of heat into the enclosure, which is generally sealed. This effectively raises the ambient temperature of the air surrounding the LEDs, thus compounding thermal related failures.

Convection occurs at any surface exposed to air, but may be limited by the amount of air movement near the emitting surface, the surface area available for dissipation, and the difference between the temperature of the emitting surface and the surrounding air. In many cases, the luminaire is enclosed further restricting airflow around the LEDs. In such an enclosure, heat generated by the LEDs is transferred by convection to the air within the enclosure, but cannot escape the boundaries of the enclosure. Although the LED itself does not contribute significant amounts of heat due to its small size, the components that are used to mount the LEDs are often large, thus allowing greater dissipation to the air within the enclosure by convection. As a result, the air within the enclosure experiences a build up of heat, which elevates lamp and luminaire temperatures and may lead to heat related failures. For example, in luminaires with electronic ballasts and components, excessive heat can shorten the life of the electronic components, resulting in premature failure of the lighting system.

Radiation is the movement of energy from one point to another via electromagnetic propagation. Much of the radiant energy escapes the luminaire through the clear optical elements (light emitting zones, lenses, etc) and reflectors, which are designed to redirect the radiant energy (visible light in particular) out of the luminaire according to the needs of the application. The radiant energy that does not escape through the lenses is absorbed by the various materials within the luminaire and converted into heat.

Of these three modes of thermal transfer, providing an effective conduction path often allows the greatest amount of controlled heat removal from within a luminaire. This is especially pertinent for luminaires that are enclosed to meet the requirements of the application (weather-proofing, concealing electrical components, safety, etc). Of particular importance is the need to optimize the thermal path to allow a low thermal resistance from the LED heat source to the dissipating surface on the exterior of the luminaire, while minimizing the cross-sectional area of the thermal path along the interior of the luminaire enclosure. A heat pipe is one mechanism that has been used to remove heat under these conditions.

A heat pipe is a tube, usually comprised of metal, that is evacuated and sealed with a small amount of fluid inside. Because the tube is sealed and evacuated, the working fluid changes from liquid to vapor at a relatively low temperature compared to the boiling point of that fluid at normal atmospheric pressure. The choice of fluid and internal pressure determine the temperature at which vaporization occurs. When a heat source is applied, the fluid will vaporize and uniformly fill the tube, resulting in a state of equilibrium where the fluid exists in both liquid and vapor form based on the amount of heat applied. If there is a location on the tube wall that is cooler than the area where the heat source is applied, the vapor will condense at that location. When fluid changes state from vapor to liquid, large amounts of energy are released.

With the addition of a special structure inside the tube, called a capillary structure, the fluid in liquid form will readily return to the spot where the heat source is applied via capillary action. The addition of the capillary structure within the tube creates a double-phase change convective thermal transfer loop that achieves a high thermal transfer coefficient over relatively large distances and small cross-sectional areas compared to what can be achieved with other thermal transfer structures. A heat pipe thus allows a relatively small heat producing area to be coupled to a large heat-dissipating surface that is far away from the heat source using a relatively small cross-sectional area structure to couple to the heat source and transfer the heat to the larger dissipating region. Such an arrangement is advantageous when the heat source is located inside an enclosed cavity with limited surface area or complex geometry for coupling to and dissipating heat.

In addition to the issue of thermal management, two compounding challenges have limited widespread adoption of LEDs for general illumination: concern over availability of LEDs as the technology changes and the prohibitive expense associated with LED replacement. The concern over LED availability is due to the fact that LEDs are very new to the market within the historical perspective of HID and fluorescent light source availability. Because LED technology is new and rapidly developing, the form factor of individual LEDs and the efficacy of LEDs change on a yearly basis. LEDs that were introduced as little as five years ago are no longer available today. LEDs that were introduced a year ago have efficacy improvement of 20 to 50%. This means that an owner, performing the simple act of purchasing replacement LEDs, will have to reconsider the impact on light levels, type of optics used, LED drivers, and thermal performance of the system. Essentially, the owner is required to perform an entire re-evaluation of the lighting installation, which is a considerable expense. Alternatively, an owner may obtain purchase agreements with LED manufacturers that ensure future availability of LEDs as originally specified. This approach, however, defeats the future energy savings potential of efficacy improvements in LED technology. These considerations are the root causes of significant concern on the part of facility owners and operators when considering LED based lighting systems. Therefore, it is desirable to have a solution that allows for forward compatibility of LED changes without impact to the form factor, thermal, or optical performance of the luminaire.

As to the concern over the expense associated with LED replacement, it is generally accepted that properly designed LED light sources within luminaires will have a lifetime of 50,000 hours. This may seem like a long time to people unfamiliar with luminaire construction, or those accustomed to residential lighting systems. A lifetime of 50,000 hours, however, is not exceptional within the general lighting industry as HID and fluorescent light sources with typical lifetimes of 20,000 to 100,000 hours have been used for decades. Furthermore, while these light sources generally provide longer life, it is desirable that they are serviceable in the event of a failure because the installed lifetime of luminaires greatly exceed the lifetime of even a 100,000 hour light source, and thus the thermal path should be able to be engaged and disengaged in a highly repeatable method with minimal introduction of thermal resistances.

Accordingly, there is a need for an LED based lighting system that includes an optimized conduction path and dissipation area to significantly reduce the amount of heat transferred from the LEDs to the interior of the enclosure, thereby allowing LED luminaires to operate in a higher ambient temperature environment without compromising luminaire life or performance. Additionally, there is a need for LED based lighting systems that allow for forward compatibility of LED changes without impact to the form factor, thermal, or optical performance of the luminaire. Finally, there is a need for LED based lighting systems that provide for LED replacement with minimal introduction of thermal resistances into the thermal path by ensuring that the thermal path engages and disengages in a highly repeatable manner.

SUMMARY OF THE INVENTION

In an exemplary embodiment of the present invention, an LED module assembly comprises a heat pipe connected to at least one contact pad, where this combination forms a thermal assembly. The LED module assembly further comprises at least one light emitting diode coupled to the contact pad, along with a heat pipe mating surface connected to an end of the thermal assembly. In some embodiments, an LED driver may be connected in close proximity to the thermal assembly and may be a PWM dimming driver.

In certain embodiments, the light emitting diode comprises an individual LED, an LED chip, or an LED die mounted to a printed circuit board coupled to the contact pad. In other embodiments, the light emitting diode comprises a printed circuit board coupled to an individual LED, an LED chip, or an LED die mounted directly to the surface of the contact pad. In some embodiments where the light emitting diode is mounted directly to the contact pad, the surface of the contact pad has at least one groove substantially parallel and opposite at least one electrical contact area on the surface of the light emitting diode to prevent contact between the electrical contact area and the contact pad.

In certain embodiments, the contact pad and the light emitting diode are dimensioned to have substantially similar surface areas. In other embodiments, the contact pad is dimensioned to accommodate a plurality of light emitting diodes.

Some embodiments include a material with a low thermal conductivity substantially surrounding the interface between the light emitting diode, the printed circuit board, and the contact pad. The material with a low thermal conductivity may also be a thermally insulating material.

In certain embodiments, a thermal junction is located between the heat pipe mating surface and an interior surface of a luminaire housing adjacent to an external heat sink. Some embodiments include a member attached to the luminaire housing that adjusts the position of the LED module assembly with respect to the housing and configured to apply mechanical force to the thermal junction when the heat pipe surface contacts the interior surface of the housing. In other embodiments, the member may be a spring loaded latch engaging and disengaging the LED module assembly at the thermal junction. Other embodiments are described and apparent from the further description of the invention below.

DETAILED DESCRIPTION OF THE INVENTION

An embodiment of the present invention proposes to reduce the thermal issues associated with lamp energy dissipation by implementing an optimized conduction path from the lamp to the exterior of the luminaire, away from thermally sensitive components, through the use of heat pipes integrated into an LED module assembly and luminaire. One advantage of using a heat pipe for thermal management is that it is a passive device, requiring no electrical energy or temperature sensing circuitry to operate. In such an embodiment, a significant reduction in thermal transfer to the interior of the enclosure may be implemented, while allowing maximum dissipation of energy from the LEDs.

Figure 1:
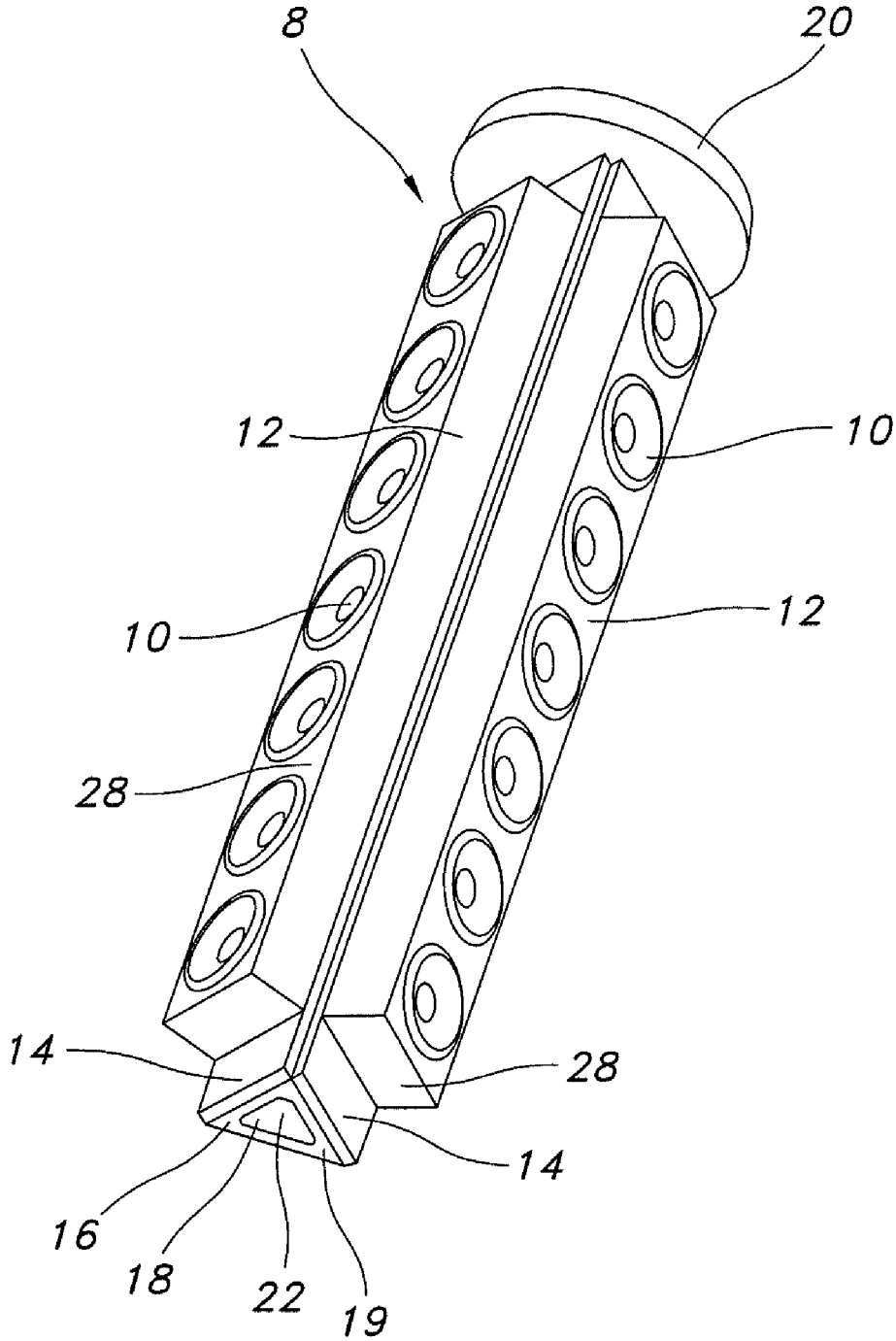
FIG. 1 is a perspective view of an exemplary embodiment of an LED module assembly according to the present invention.
Figure 3:
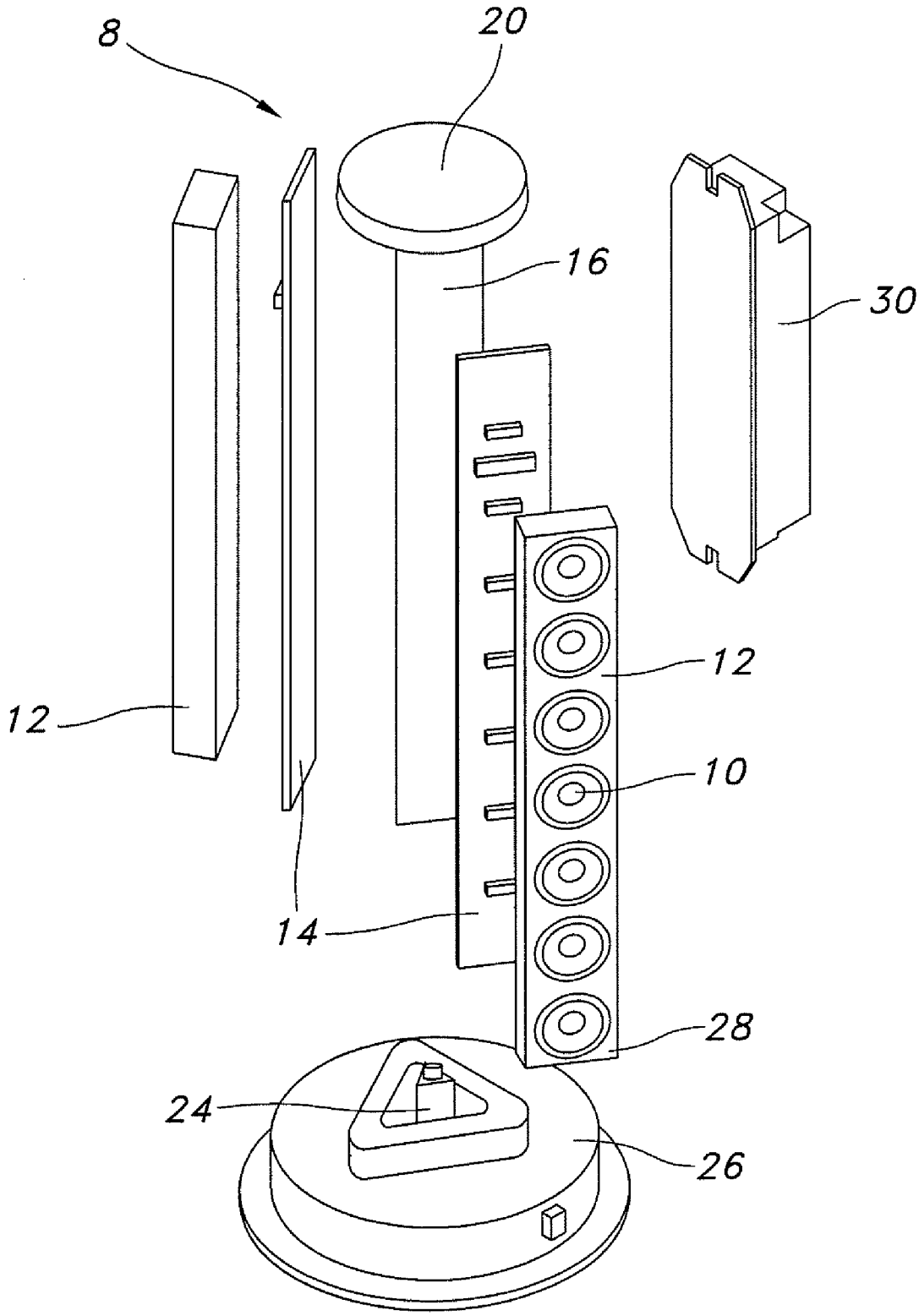
FIG. 3 is a fully exploded view of LED module assembly shown in FIG. 1.

As illustrated in FIG. 1, an LED module assembly 8 according to one exemplary embodiment of the present invention includes a plurality of LEDs 10 surrounded by a structure 12. Each LED 10 is mounted to a surface of a printed circuit board ("PCB") 14. The surfaces of PCB 14 opposite the surfaces coupled to LEDs 10 are coupled to a plurality of thermal transfer interfaces ("contact pads") 16 that are in turn coupled to internal heat pipe 18. The structure including the connection of contact pads 16 to internal heat pipe 18 is referred to as thermal assembly 19. One end of thermal assembly 19 is connected to a heat pipe mating surface 20. The opposing end of thermal assembly 19 contains an aperture 22 designed to receive protuberance 24 located on base 26, as shown in FIG. 3. LEDs 10, PCB 14, and structure 12 are collectively referred to as LED mounting structure 28.

In these embodiments, structure 12 substantially covers LEDs 10, PCBs 14, and thermal assembly 19 to ensure that the heat pipe is the main conduit for flow of thermal energy. In one embodiment, structure 12 is a material with a low thermal conductivity. In another embodiment, structure 12 is a thermally insulating material.

In certain embodiments, contact pad 16 and LED 10 are dimensioned to have substantially similar surface areas. In other embodiments, contact pad 16 is dimensioned to accommodate a plurality of LEDs 10, thus allowing greater flexibility in positioning LEDs 10 as needed to meet optical performance requirements.

In certain embodiments of the present invention, LED replacement is incorporated into the present invention to allow for forward compatibility of the LED lamp and to allow replacement LED module assemblies 8 to be manufactured in a manner that does not affect the optical or thermal performance of the original luminaire 32 (shown in FIGS. 4-6) and its LED module assembly 8 as the replacement unit will have LEDs 10 in the same physical location relative to the optics, and also incorporate the same thermal mechanism (internal heat pipe 18). With higher efficacy LEDs 10 driven in a dimmed state in the same physical location, optical performance equivalent to the original luminaire 32 and LED module assembly 8 is achieved.

Figure 2:
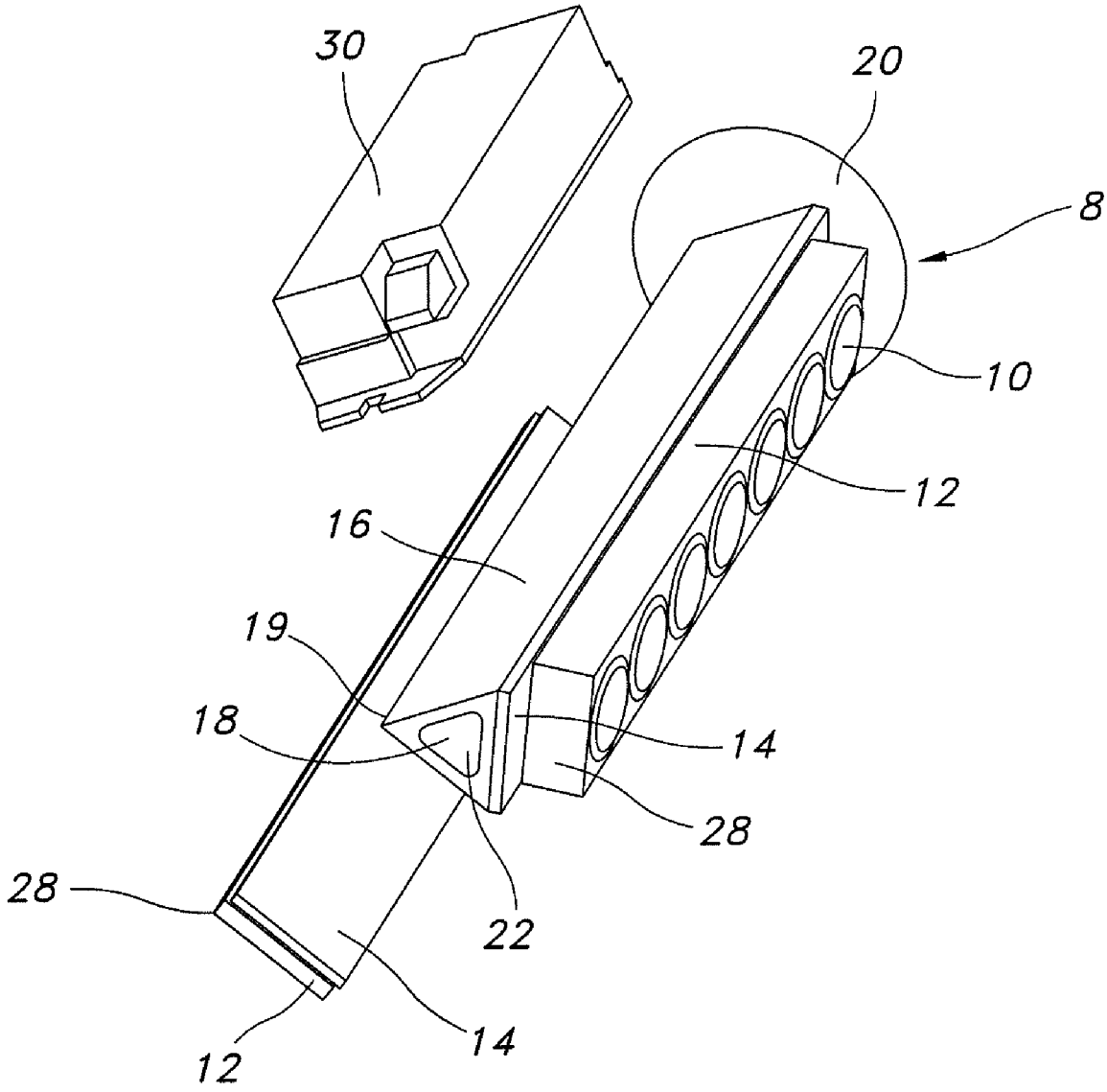
FIG. 2 is a partially exploded view of the LED module assembly shown in FIG. 1.

FIG. 2 is a rotated and partially exploded view of LED module assembly 8 and including LED driver 30 that is connected to a contact pad 16 adjacent to two LED mounting structures 28. In one embodiment, LEDs 10 and LED driver 30 are serviceable as a single LED module assembly 8. An exemplary LED driver 30 has a lifetime of 50,000 hours, which is complementary to the lifetime of LEDs 10, and thus replacement of a single LED module assembly 8 containing both LEDs 10 and LED driver 30 will minimize service costs. Moreover, an LED module assembly 8 containing both LEDs 10 and LED driver 30 provides for forward compatibility of the LED lamp. By integrating LED driver 30 with LEDs 10 in a single replacement LED module assembly 8, LED driver 30 may be appropriately designed for future LEDs 10 with improved efficacy. Several approaches are available to enable this forward compatibility of driver and LEDs.

In one embodiment of the invention, LED driver 30 may be designed as a PWM dimming driver, thus allowing LEDs 10 to be dimmed to factory specified levels that match the original LED/driver combination. One advantage of this approach is that LED driver 30 does not change over time, rather only the "dim level" changes. In this embodiment, there is no consideration regarding form factor changes for the luminaire/LED lamp manufacturer. In another embodiment, a non-dimming LED driver 30 is redesigned periodically to accommodate efficacy improvements in LEDs 10.

In some embodiments, LED driver 30 may be placed in close proximity to thermal assembly 19 because LEDs 10 and the thermal conduction path are isolated. In other embodiments, the LED driver 30 may be directly attached to the thermal assembly 19.

FIG. 3 is a fully exploded view of LED module assembly 8 and a base 26 with protuberance 24. Protuberance 24 is inserted into aperture 22 (shown in FIGS. 1 and 2) to retain LED module assembly 8 within a housing 34 of luminaire 32 (shown in FIGS. 4-6).

Figure 4:
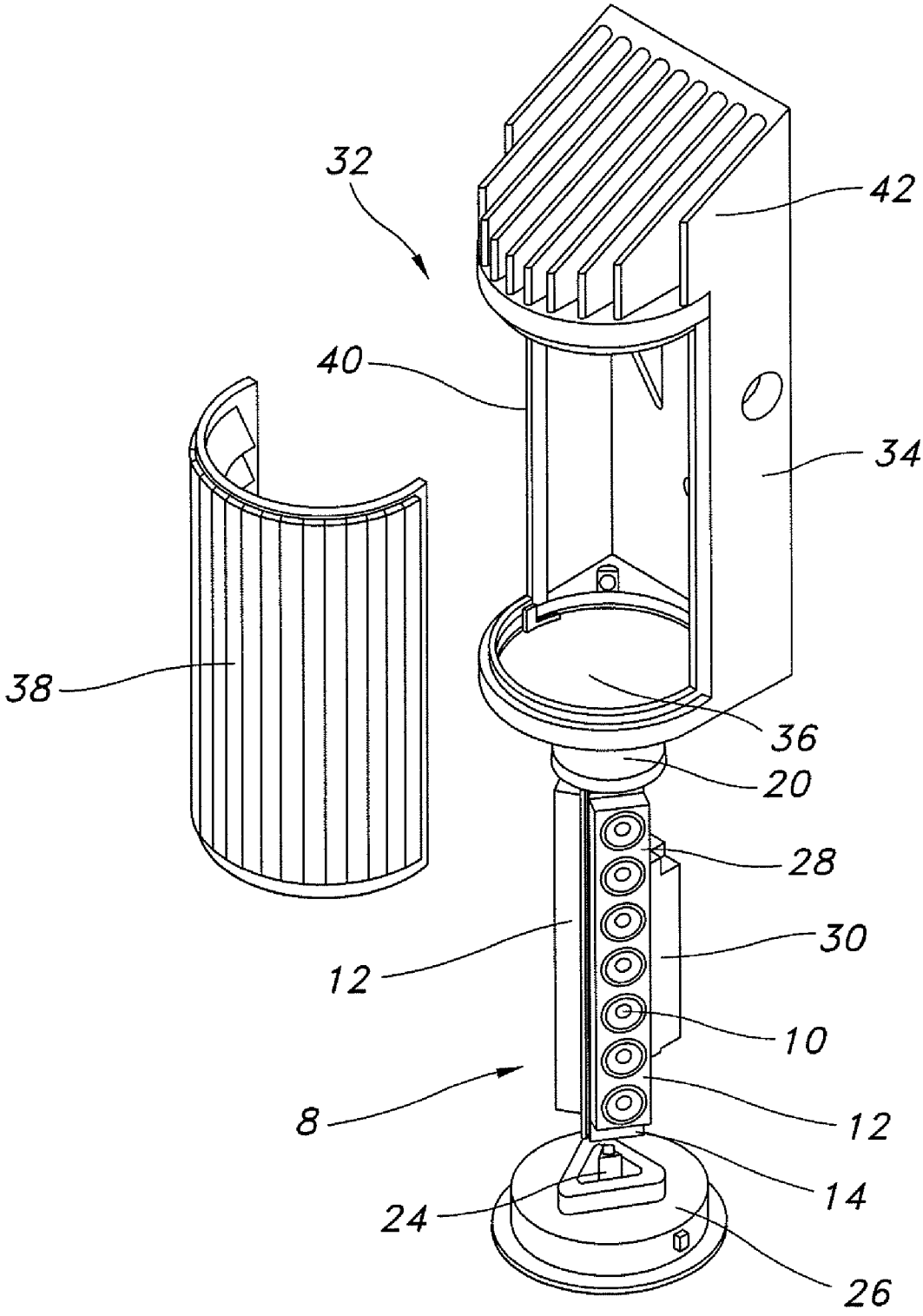
FIG. 4 is an exploded view illustrating how the LED module assembly shown in FIG. 1 is connected to a luminaire housing.

FIG. 4 is an exploded view of an exemplary embodiment of luminaire 32, which illustrates that LED module assembly 8 may be connected to base 26 by inserting protuberance 24 into aperture 22, as shown in FIGS. 1 and 2. In this embodiment, LED module assembly 8 may be inserted into housing 34 through opening 36. Base 26 may be securely connected to housing 34 adjacent to opening 36. Some embodiments utilize a housing cover 38 to cover aperture 40 in housing 34. External heat sink 42 may be connected to the exterior surface of housing 34 at an end opposite opening 36.

Figure 5:
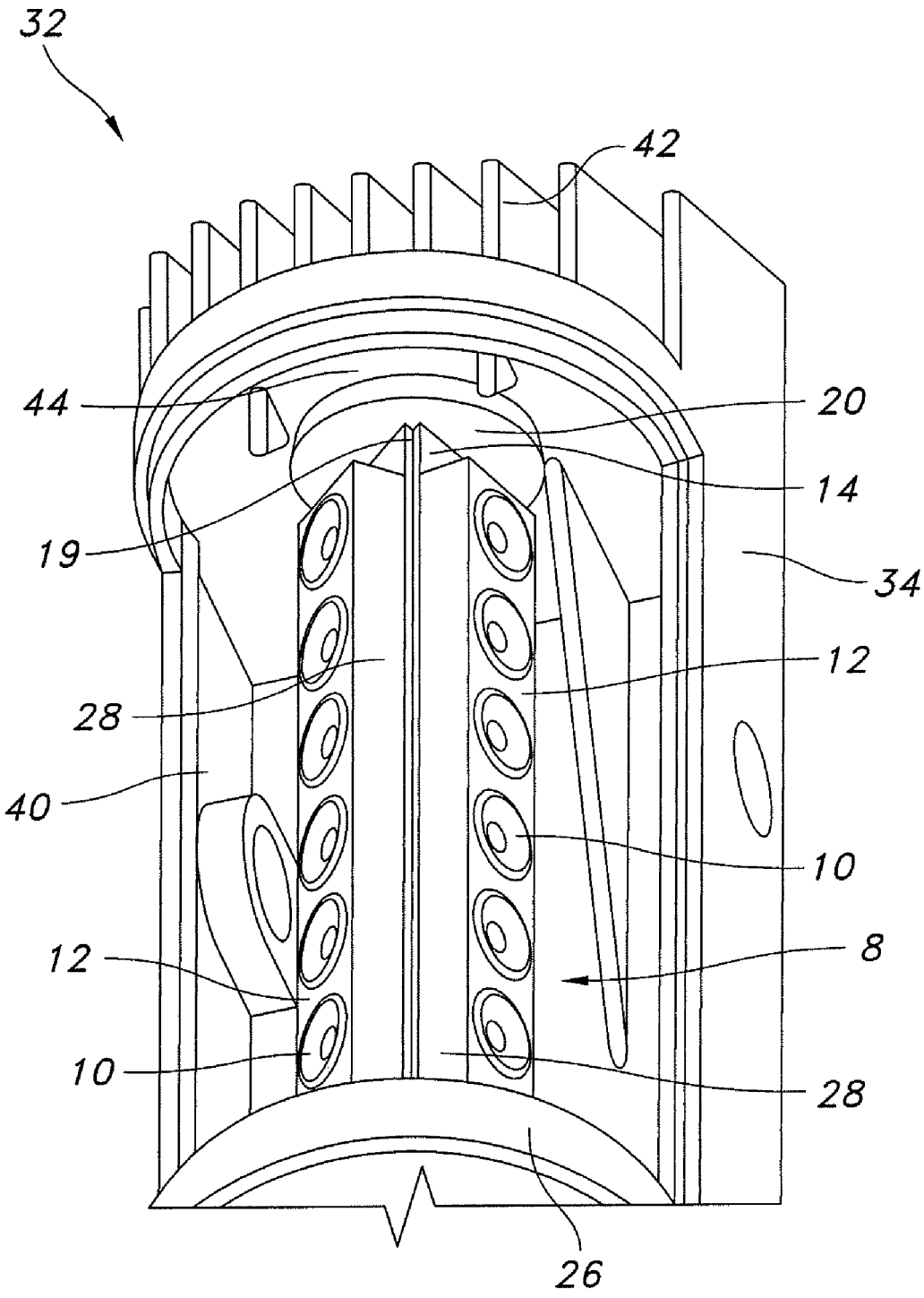
FIG. 5 is a partial perspective view of a fully assembled luminaire, with the LED module assembly shown in FIG. 1 in an engaged position relative to a luminaire housing.

In another embodiment, as illustrated in FIG. 5, after LED module assembly 8 is inserted through opening 36, external heat sink 42 may be connected to internal heat pipe 18 (shown in FIGS. 1 and 2). This is done by placing an interior surface of housing 34 that is adjacent to external heat sink 42 in direct contact with heat pipe mating surface 20, which is connected to thermal assembly 19, thus reducing the number of thermal interfaces and improving heat transfer out of the luminaire enclosure. In these embodiments, internal heat pipe 18 is also connected to external heat sink 42 through connection of aperture 22 (shown in FIGS. 1 and 2) to protuberance 24 on base 26 (shown in FIGS. 3 and 4), which is connected to housing 34 and thus to external heat sink 42.

In these embodiments, thermal junction 44 is created when heat pipe mating surface 20 contacts the interior surface of housing 34. When heat pipe mating surface 20 contacts housing 34, the LED module assembly 8 may be considered to be in an engaged position relative to housing 34. In some embodiments, to reduce thermal resistance of thermal junction 44, some mechanical force is applied when the LED module assembly 8 is placed in an engaged position relative to housing 34. One embodiment may include the use of a spring loaded member to achieve some mechanical force between heat pipe mating surface 20 and housing 34. To further minimize thermal resistance of thermal junction 44, heat pipe mating surface 20 and the interior surface of housing 34 should have complementary mating surfaces that are generally flat and substantially smooth. In order to ensure easy servicing, appropriate guides should be implemented that orient and seat the heat pipe mating surface 20 relative to housing 34 without any effort required of the service personnel. The orientation feature also provides proper alignment of the LED 10 and the optical elements within the luminaire 32.

Figure 6:
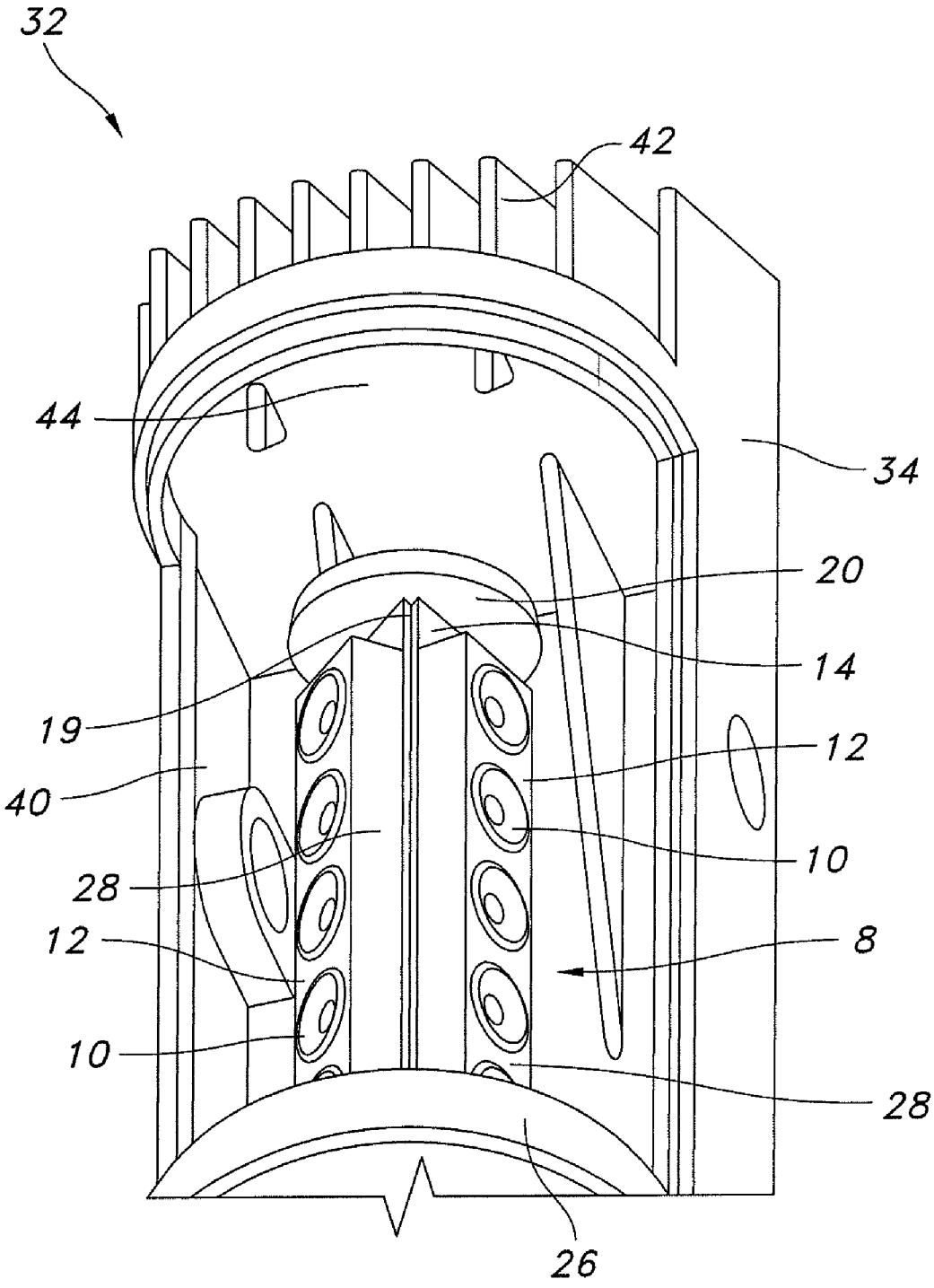
FIG. 6 is a partial perspective view of a fully assembled luminaire, with the LED module assembly shown in FIG. 1 in a disengaged position relative to a luminaire housing.

FIG. 6 is a perspective view of one embodiment of luminaire 32, showing LED module assembly 8 in a disengaged position relative to housing 34. In this position, heat pipe mating surface 20 is not in contact with housing 34. This position allows LED module assembly 8 to be serviced without the need for substantial adjustment by service personnel.

Figure 7:
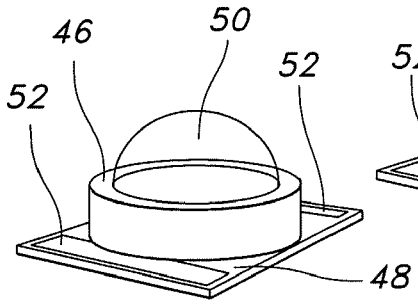
FIG. 7 is a perspective view of an exemplary embodiment of an LED.
Figure 8:
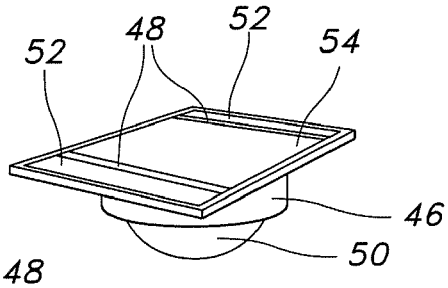
FIG. 8 is a rotated perspective view of the LED shown in FIG. 7.
Figure 9:
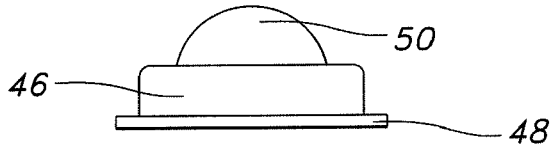
FIG. 9 is a side view of the LED shown in FIG. 7.
Figure 10:
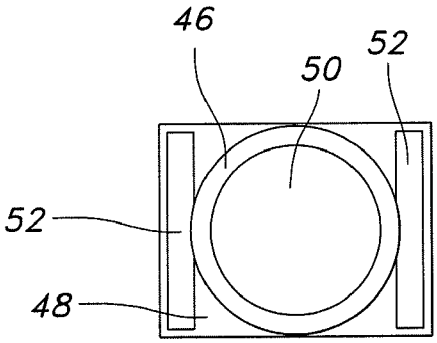
FIG. 10 is a top view of the LED shown in FIG. 7.
Figure 11:
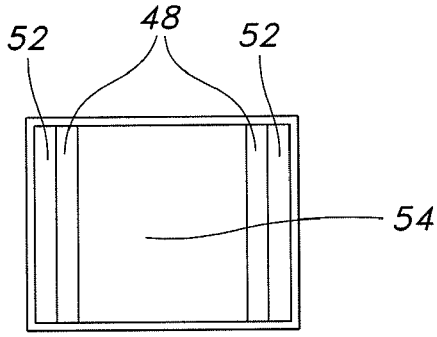
FIG. 11 is a bottom view of the LED shown in FIG. 7.
Figure 12:
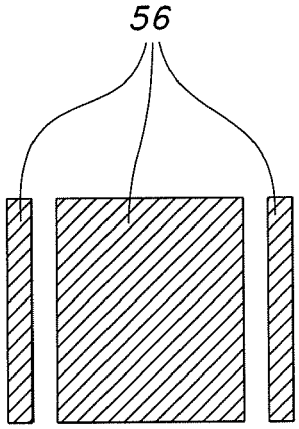
FIG. 12 is a top view of an exemplary embodiment of a solder pad, which is used to connect to the LED shown in FIG. 7.

FIG. 7 is a perspective view of an exemplary embodiment of LED 10. LED reflector 46 is attached to a surface of substrate 48. LED lens 50 is attached to LED reflector 46 on a surface of LED reflector 46 that opposes the surface of LED reflector 46 that is attached to substrate 48. A plurality of electrical contact areas 52 are located on the surface of substrate 48 adjacent to LED reflector 46. FIG. 8 is a rotated perspective view of LED 10, which shows a plurality of electrical contact areas 52 located on the opposite surface of substrate 48 and substantially aligned with electrical contact areas 52 that are adjacent to LED reflector 46. The section of the surface of substrate 48 adjacent to electrical contact areas 52 and on the opposite side of substrate 48 from LED reflector 46 is referred to as thermal contact area 54. FIGS. 9-11 show side, top, and bottom views, respectively, of LED 10. FIG. 12 illustrates one embodiment of a solder pad 56 that is used to connect LED 10 to PCB 14.

Another embodiment of the present invention, as illustrated in FIGS. 13-16, further improves the conduction path by placing thermal contact area 54 in direct contact with contact pad 16, thus eliminating an additional source of thermal resistance. This embodiment utilizes the electrical contact areas 52 on the front side of LED 10 to connect to a PCB 14 (not shown), while providing an electrically neutral thermal transfer area 54 on the back side of LED 10 to mount directly to contact pad 16. Cree XL7090 LEDs, for example, provide such electrical contact areas 52 on the front side of LED 10. In some embodiments, structure 12 is first attached to PCBs 14 and LEDs 10, then coupled to thermal assembly 19 to achieve a direct interface from LED 10 to the heat transfer area. This embodiment has a lower thermal resistance when compared to the same LED 10 mounted to a PCB 14 that is in turn mounted to the thermal assembly 19. In another specific embodiment, an LED "die" or "chip," along with an encapsulant, may be directly mounted to the contact pads 16 with appropriate electrical isolation between the die and chips.

Figure 13:
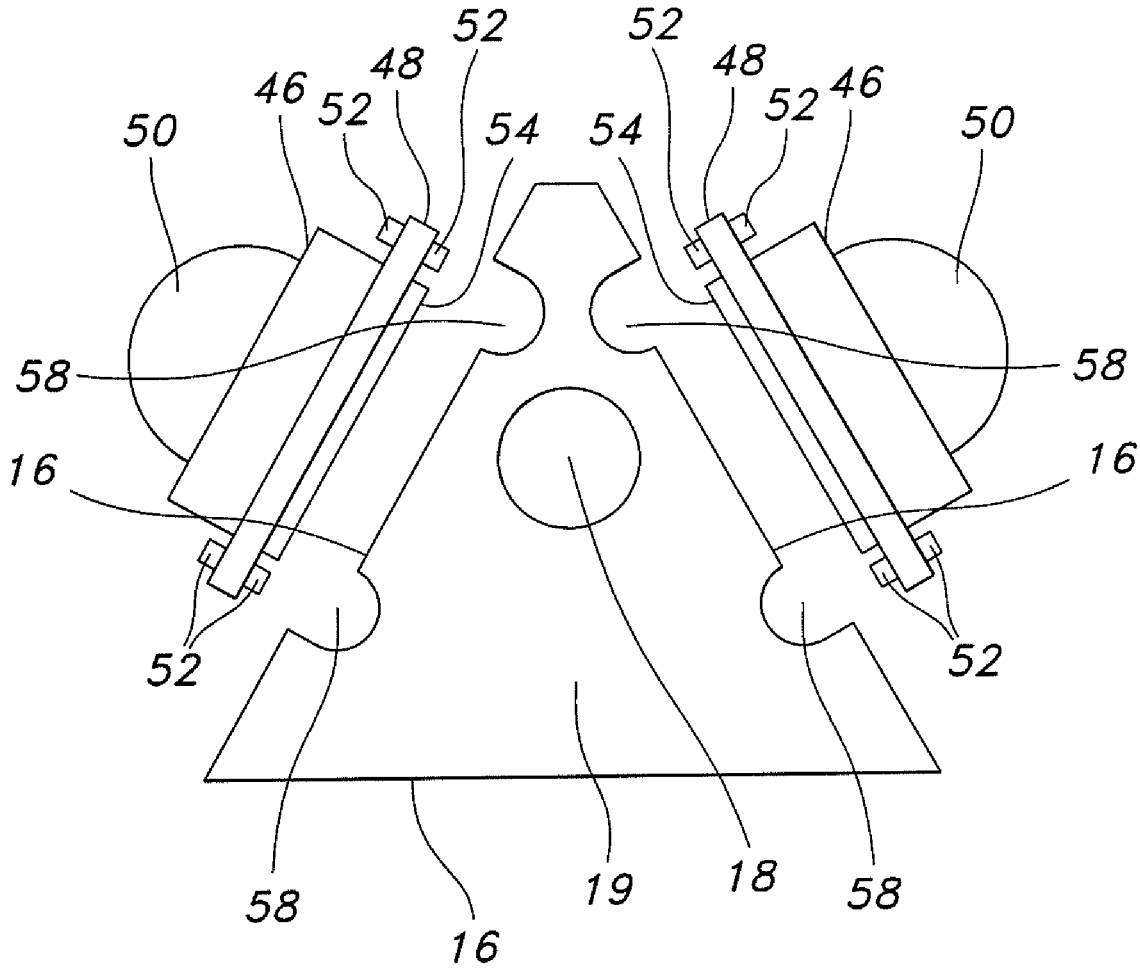
FIG. 13 is a side view illustrating how the LED shown in FIG. 7 may be directly connected to a thermal assembly.

As shown in FIG. 13, at least one groove 58 is located on the surface of contact pads 16 substantially parallel and opposite at least one electrical contact area 52 on the bottom of LED 10. Grooves 58 are intended to prevent contact between electrical contact areas 52 and contact pad 16 so that LED 10 will not short out.

Figure 14:
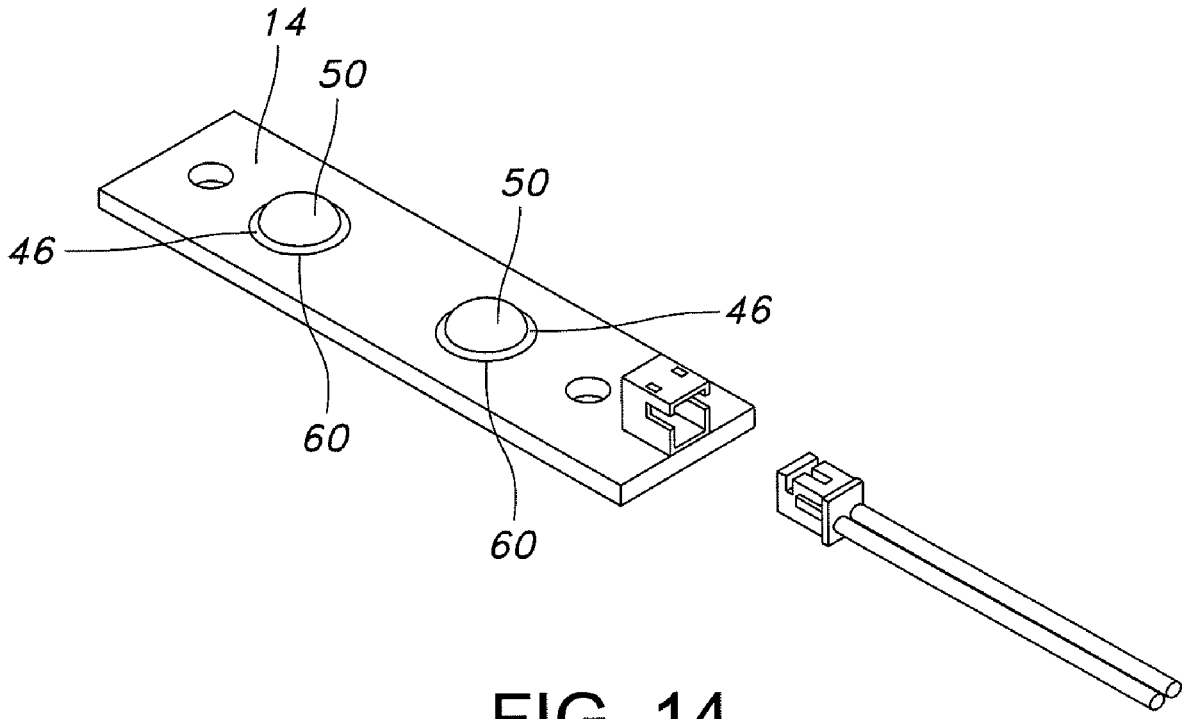
FIG. 14 is a perspective view illustrating how the LED shown in FIG. 7 may be connected to a printed circuit board ("PCB").
Figure 15:
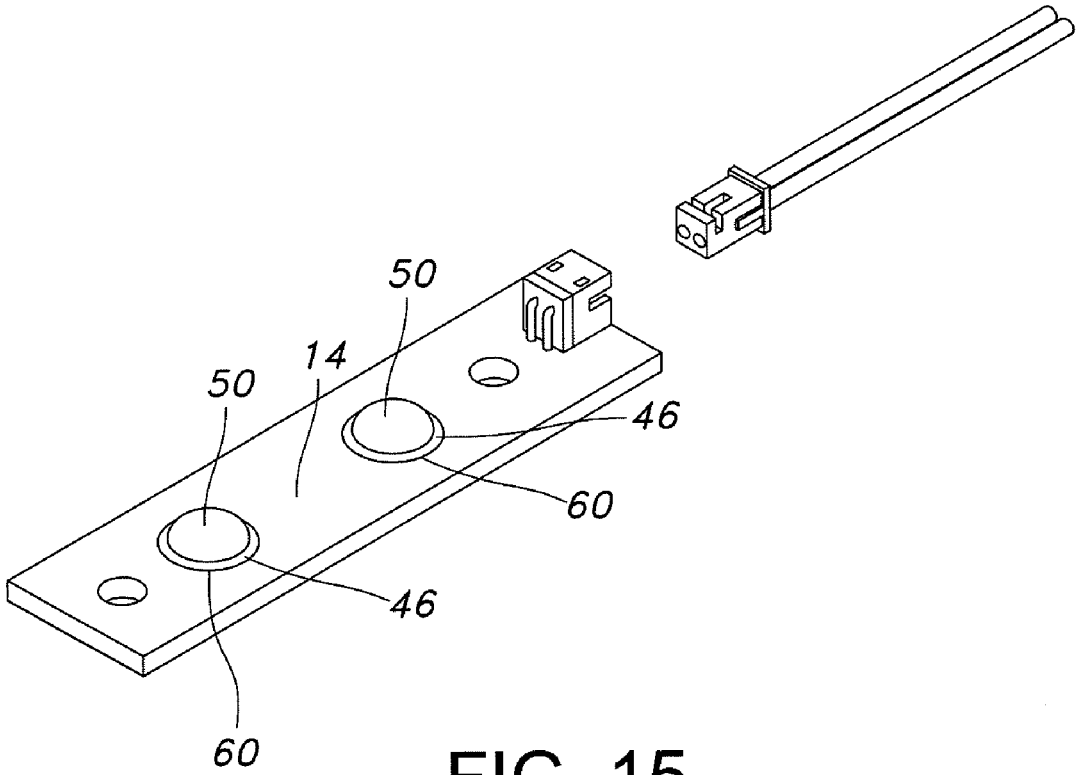
FIG. 15 is a rotated view of the LED and PCB shown in FIG. 14.
Figure 16:
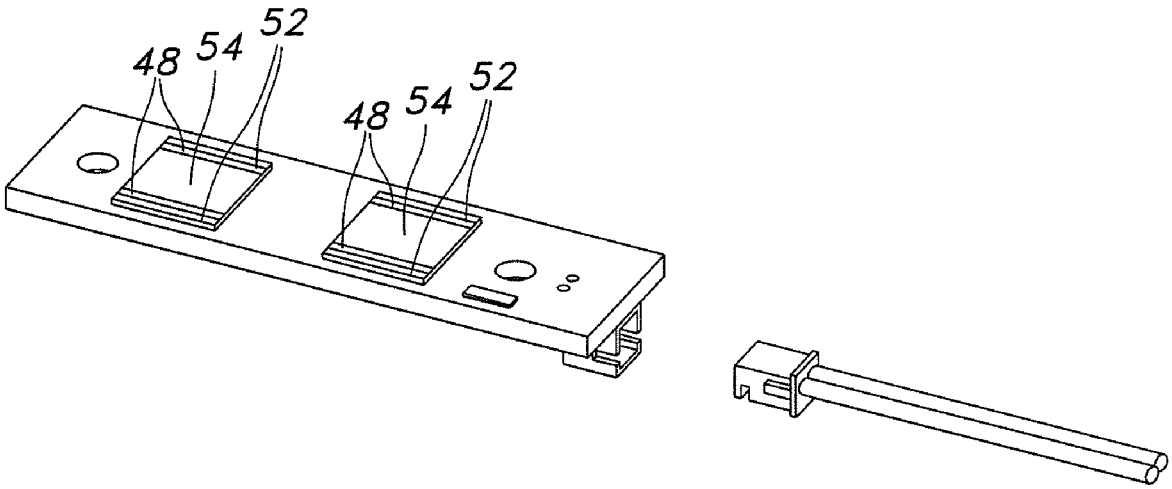
FIG. 16 is a rotated view showing the underside of the LED and PCB shown in FIG. 14.

FIGS. 14 and 15 illustrate use of a plurality of LED apertures 60 to allow LED lens 50 and LED reflector 46 to extend through PCB 14 when PCB 14 is connected to electrical contact areas 52 on the surface of substrate 48 adjacent to LED reflector 46. FIG. 16 is a bottom view of this embodiment showing a plurality of electrical contact areas 52 and thermal contact areas 54 located on the surfaces of substrates 48 opposite the sides of substrates 48 connected to LED reflectors 46.

The foregoing description of the exemplary embodiments of the invention has been presented only for the purposes of illustration and description and is not intended to be exhaustive or to limit the invention to the precise forms described. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope.

What is claimed is:

1. An apparatus comprising:

an LED module assembly comprising:

a thermal assembly comprising a heat pipe and a contact pad coupled to an exterior surface of the heat pipe;

at least one light emitting diode coupled to the contact pad; and the heat pipe comprising a first end and a second end, wherein the first end of the heat pipe is coupled to a heat pipe mating surface a luminaire housing, wherein an inner surface of the luminaire housing comprises a housing mating surface, and wherein the heat pipe mating surface is configured to contact and releasably mate with the housing mating surface to define a thermal junction; and a luminaire base, wherein the luminaire base is coupled to the second end of the heat pipe and coupled to the luminaire housing, wherein the first end and the second end of the heat pipe are enclosed by the coupled luminaire housing and the luminaire base.

2. The apparatus of claim 1, further comprising an LED driver connected to the thermal assembly.

3. The apparatus of claim 1, wherein the at least one light emitting diode comprises an individual LED, an LED chip, or an LED die.

4. The apparatus of claim 1, wherein the at least one light emitting diode is coupled to the contact pad by mounting the at least one light emitting diode to a printed circuit board that is attached to the contact pad.

5. The apparatus of claim 1, wherein the at least one light emitting diode is mounted directly to a surface of the contact pad.

6. The apparatus of claim 5, wherein the contact pad has at least one groove formed on the surface of the contact pad substantially parallel and opposite at least one electrical contact area to prevent contact between the electrical contact area and the contact pad at the groove.

7. The apparatus of claim 1, further comprising a material with a low thermal conductivity substantially surrounding the at least one light emitting diode.

8. The apparatus of claim 7, wherein the material with a low thermal conductivity is a thermally insulating material.

9. The apparatus of claim 1, wherein the contact pad and the at least one light emitting diode are dimensioned to have substantially similar surface areas.

10. The apparatus of claim 1, wherein the contact pad is dimensioned to accommodate a plurality of light emitting diodes.

11. An apparatus comprising:

an LED module assembly comprising:

a thermal assembly comprising a heat pipe and a contact pad coupled to an exterior surface of the heat pipe;

at least one light emitting diode comprising a front side, a back side, and an electrical contact area, wherein the back side of the at least one light emitting diode is coupled directly to the contact pad;

a groove formed on a surface of the contact pad substantially parallel and opposite the electrical contact area to prevent contact between the electrical contact area and the contact pad at the groove;

a printed circuit board coupled to the front side of the at least one light emitting diode; and the heat pipe comprising a first end and a second end, wherein the first end of the heat pipe is coupled to a heat pipe mating surface;

a luminaire housing, wherein an inner surface of the luminaire housing comprises a housing mating surface, and wherein the heat pipe mating surface is configured to contact and releasably mate with the housing mating surface to define a thermal junction; and a luminaire base, wherein the luminaire base is coupled to the second end of the heat pipe and coupled to the luminaire housing, wherein the first end and the second end of the heat pipe are enclosed by the coupled luminaire housing and the luminaire base.

12. The apparatus of claim 11, wherein the at least one light emitting diode comprises an individual LED, an LED chip, or an LED die.

13. The apparatus of claim 11, further comprising a material with a low thermal conductivity substantially surrounding the at least one light emitting diode.

14. The apparatus of claim 13, wherein the material with a low thermal conductivity is a thermally insulating material.

15. The apparatus of claim 11, wherein the contact pad and the at least one light emitting diode are dimensioned to have substantially similar surface areas.

16. The apparatus of claim 11, wherein the contact pad is dimensioned to accommodate a plurality of light emitting diodes.

17. The apparatus of claim 11, further comprising an LED driver connected to the thermal assembly.

18. The apparatus of claim 17, wherein the LED driver is a PWM dimming driver.

19. An apparatus comprising:

an LED module assembly comprising:

a thermal assembly comprising a heat pipe and a contact pad coupled to an exterior surface of the heat pipe;

at least one light emitting diode coupled to the contact pad; and the heat pipe comprising a first end and a second end, wherein the first end of the heat pipe is coupled to a heat pipe mating surface a luminaire housing, wherein an inner surface of the luminaire housing comprises a housing mating surface, and wherein the heat pipe mating surface is configured to contact and releasably mate with the housing mating surface to define a thermal junction;

a luminaire base, wherein the luminaire base is coupled to the second end of the heat pipe and coupled to the luminaire housing, wherein the first end and the second end of the heat pipe are enclosed by the coupled luminaire housing luminaire base; and an external heat sink provided on an outer surface of the luminaire housing proximate the housing mating surface.

20. The apparatus of claim 19, further comprising an LED driver connected to the thermal assembly.

21. The apparatus of claim 19, wherein the at least one light emitting diode comprises an individual LED, an LED chip, or an LED die mounted to a printed circuit board that is attached to the contact pad.

22. The apparatus of claim 19, further comprising a spring loaded member for biasing the heat pipe mating surface towards the housing mating surface.

23. The apparatus of claim 19, wherein the thermal assembly comprises the heat pipe and the contact pad integrated as single structure.

24. An apparatus comprising:

an LED module assembly comprising:

a thermal assembly comprising a heat pipe and a contact pad coupled to an exterior surface of the heat pipe;

at least one light emitting diode comprising a front side, a back side, and an electrical contact area, wherein the back side of the at least one light emitting diode is coupled directly to the contact pad;

a groove formed on a surface of the contact pad substantially parallel and opposite the electrical contact area to prevent contact between the electrical contact area and the contact pad at the groove;

a printed circuit board coupled to the front side of the at least one light emitting diode; and the heat pipe comprising a first end and a second end, wherein the first end of the heat pipe is coupled to a heat pipe mating surface;

a luminaire housing, wherein an inner surface of the luminaire housing comprises a housing mating surface, and wherein the heat pipe mating surface is configured to contact and releasably mate with the housing mating surface to define a thermal junction;

a luminaire base, wherein the luminaire base is coupled to the second end of the heat pipe and coupled to the luminaire housing, wherein the first end and the second end of the heat pipe are enclosed by the coupled luminaire housing and the luminaire base; and an external heat sink provided on an outer surface of the luminaire housing proximate the housing mating surface.

25. The apparatus of claim 24, further comprising a spring loaded member for biasing the heat pipe mating surface towards the housing mating surface.

* * * * *